US009359658B2

(12) United States Patent
Innocenti et al.

(10) Patent No.: US 9,359,658 B2
(45) Date of Patent: Jun. 7, 2016

(54) NICKEL-BASED SUPERALLOY, MECHANICAL COMPONENT MADE OF THE ABOVE MENTIONED SUPER ALLOY, PIECE OF TURBOMACHINERY WHICH INCLUDES THE ABOVE MENTIONED COMPONENT AND RELATED METHODS

(75) Inventors: Marco Innocenti, Firenze (IT); Pasquale Maresca, Firenze (IT); Oriana Tassa, Rome (IT); Andrea Carosi, Rome (IT); Barbara Giambi, Rome (IT); Claudio Testani, Rome (IT)

(73) Assignee: Nuovo Pignone S.p.A, Florence (IT)

( * ) Notice: Subject to any disclaimer, the term of this patent is extended or adjusted under 35 U.S.C. 154(b) by 354 days.

(21) Appl. No.: 12/844,185

(22) Filed: Jul. 27, 2010

(65) Prior Publication Data

US 2011/0165012 A1 Jul. 7, 2011

(30) Foreign Application Priority Data

Jul. 29, 2009 (IT) ..... CO2009A0027

(51) Int. Cl.

| | |
|---|---|
| ***C22C 19/05*** | (2006.01) |
| ***C22C 1/04*** | (2006.01) |
| ***C22C 1/05*** | (2006.01) |
| ***C22C 32/00*** | (2006.01) |

(52) U.S. Cl.

CPC ..... *C22C 19/057* (2013.01); *C22C 1/0433* (2013.01); *C22C 1/05* (2013.01); *C22C 32/0015* (2013.01); *Y10T 29/49229* (2015.01)

(58) Field of Classification Search

CPC ..... C22C 19/057; C22C 1/0433; C22C 1/05; C22C 32/0015

See application file for complete search history.

(56) References Cited

U.S. PATENT DOCUMENTS

| | | | | |
|---|---|---|---|---|
| 3,167,426 | A | 1/1965 | Freche et al. | |
| 3,567,526 | A | 3/1971 | Gell et al. | |
| 3,650,635 | A | 3/1972 | Wachtell et al. | |
| 3,809,545 | A * | 5/1974 | Benjamin | 75/255 |
| 3,890,816 | A * | 6/1975 | Allen et al. | 75/255 |
| 3,904,402 | A | 9/1975 | Smashey | |
| 4,013,424 | A | 3/1977 | Wildgoose et al. | |
| 4,226,644 | A | 10/1980 | Cox et al. | |
| 4,386,976 | A | 6/1983 | Benn et al. | |
| 4,427,447 | A * | 1/1984 | Ramanarayanan et al. | 75/252 |
| 4,522,664 | A | 6/1985 | Gigliotti, Jr. et al. | |
| 4,707,192 | A | 11/1987 | Yamazaki et al. | |
| 4,781,772 | A * | 11/1988 | Benn et al. | 148/404 |
| 4,878,965 | A | 11/1989 | Gostic et al. | |
| 4,995,922 | A * | 2/1991 | Jongenburger | 148/428 |
| 5,035,958 | A | 7/1991 | Jackson et al. | |
| 5,047,091 | A | 9/1991 | Khan et al. | |
| 5,100,484 | A | 3/1992 | Wukusick et al. | |
| 5,240,518 | A | 8/1993 | Wortman et al. | |
| 5,470,371 | A * | 11/1995 | Darolia | 75/229 |
| 5,540,789 | A | 7/1996 | Bornstein et al. | |
| 6,074,602 | A | 6/2000 | Wukusick et al. | |
| 6,419,763 | B1 | 7/2002 | Konter et al. | |
| 7,501,665 | B2 | 3/2009 | Yasuda et al. | |
| 7,871,247 | B2 | 1/2011 | Shah et al. | |
| 2008/0240926 | A1 | 10/2008 | Kobayashi et al. | |

FOREIGN PATENT DOCUMENTS

| | | | |
|---|---|---|---|
| EP | 214080 | A2 | 11/1987 |
| EP | 0971041 | A1 | 1/2000 |
| FR | 2543577 | A1 | 10/1984 |
| GB | 1243155 | | 8/1971 |
| GB | 1333014 | | 10/1973 |
| GB | 2235697 | A | 12/1986 |
| JP | 5032017 | A | 3/1975 |
| JP | 58039760 | A | 3/1983 |
| JP | 63053232 | A | 3/1988 |
| JP | 7070678 | A | 3/1995 |
| JP | 2005248955 | A | 9/2005 |
| WO | 2006067189 | A1 | 6/2006 |

OTHER PUBLICATIONS

Ritzert, F.J., Yun, H.M., Miner, R.V., "Single crystal fibers of yttria-stabilized cubic zirconia with ternary oxide additions", Journal of Materials Science, Kluwer Academic Publishers, 33 (1998) pp. 5339-5349.*

Caron, P., "High γ' solvus new generation nickel-based superalloys for single crystal turbine blade applications,"Proceedings of the 9th International Symposium on Superalloys pp. 737-746.*

Ko, H. S., et al. "Influence of rhenium on the microstructures and mechanical properties of a mechanically alloyed oxide dispersion-strengthened nickel-base superalloy." Journal of materials science 33.13 (1998): 3361-3370.*

EP Search Report and Search Opinion issued in connection with corresponding EP Application No. 10171141.4 on Feb. 16, 2011.

Notice of Opposition dated Jan. 11, 2013 related to corresponding EP Application No. 10171141.4.

Unofficial English Translation of Japanese Notice of Allowance issued in connection with corresponding JP Application No. 2010-168720 on Jul. 28, 2015.

K. Harris, G.L. Erickson, S.L. Sikkenga, W. Brentnall, J.M. Aurrecoechea and K.G. Kubarych, "Development of the rhenium containing superalloys CMSX-4® & CM 186 LC® for single crystal blade and directionally solidified vane applications in advanced turbine engines" Superallovs, ed. S.D. Antolovitch et al., (Warrendale, PA, USA, 1992), 297-306.

A.F. Giamei and D.L. Anton, "Rhenium Additions to a Ni-base Superalloy: Effects on Microstructure", Metal1Tram16A, (1985), 1997-2005.

D. Locq, P. Caron, "On Some Advanced Nickel-Based Superalloys for Disk Applications", Aerospacelab Journal, (Nov. 2011), 1-9.

M. Morinaga, N. Yukawa, H. Adachi, H. Ezaki, "New Phacomp and its Applications to Alloy Design". Superalloys, ed. M. Gell et al., (Warrendale, PA, USA, 1984), 523-532.

* cited by examiner

*Primary Examiner* — Jessee Roe

(74) *Attorney, Agent, or Firm* — GE Global Patent Operation

(57) ABSTRACT

A nickel-based superalloy particularly suitable for the fabrication of mechanical components for a piece of turbomachinery that it comprises the following elements in percentage by weight: chromium between 3% and 7%; tungsten between 3% and 15%; tantalum between 4% and 6%; aluminum between 4% and 8%; carbon less than 0.8%; the remaining percentage of nickel plus impurities.

16 Claims, 4 Drawing Sheets

NICKEL-BASED SUPERALLOY, MECHANICAL COMPONENT MADE OF THE ABOVE MENTIONED SUPER ALLOY, PIECE OF TURBOMACHINERY WHICH INCLUDES THE ABOVE MENTIONED COMPONENT AND RELATED METHODS

CROSS-REFERENCE TO RELATED APPLICATIONS

This application claims priority under 35 U.S.C. §119(a)-(d) or (f) to prior-filed, co-pending Italian application number CO2009A000027, filed on Jul. 29, 2009, which is hereby incorporated by reference in its entirety.

BACKGROUND OF THE INVENTION

1. Field of Invention

This invention relates to a new nickel-based superalloy and to a method to obtain it.

The invention also relates to a mechanical component made with the above mentioned superalloy, a piece of turbomachinery where the component will be fitted and a specific application method.

2. Description of the Prior Art

Usually in the field of materials technology, the problems related to the creation of mechanical components which work at high temperatures are solved by using cooling systems or thermal barriers in order to cool the material which they are made of, thus increasing the mechanical resistance. As a matter of fact, at a high temperature the life of the component is shortened if a cooling system is not planned adequately; it might be necessary to lower the temperature during use to extend the life of the component up to a standard value.

Many types of alloys, which are combinations of several elements in which at least one is a metal, have been developed in order to try to obtain a material which, at a high temperature when in use, will show high mechanical resistance and at the same time specific characteristics related to chemical resistance (against corrosion, erosion, or others) based on the specific application. More specifically, in case of turbomachinery components, the use of cooling systems entails complex production processes, and entails a decrease in performance of the specific piece of machinery; this proves that the choice of material which the components are made of is fundamental.

Nickel superalloys are special alloys developed to cope with high temperatures, designed to have good mechanical resistance coupled with high resistance against oxidation at temperatures of around 1000° C., and they are mostly used in the aeronautical and/or aero spatial fields (albeit not exclusively). These nickel-based superalloys include a very wide category of metal based alloys, which are constantly undergoing improvements and research, because the chemical elements involved can be associated differently, based on quantity and number, in a very malleable way, thus obtaining gradual differences based on the specific combination or mixture of elements.

Thus, currently, despite the progress in technology, this issue is still problematic and the necessity to create improved nickel-based superalloys is imperative. The need of superalloys having higher mechanical, chemical and thermal resistance in order to produce more cost effective and better performing pieces of machinery arises.

SUMMARY OF THE INVENTION

One of the purposes of the invention is creating a nickel-based superalloy which will allow operations at higher temperatures than the traditional ones, improving, at the same time, mechanical and chemical resistance and partially overcoming some of the above mentioned issues.

Further purposes of this invention are: the creation of a method to produce such superalloy, the creation of a mechanical component made of this superalloy and the creation of a piece of machinery in which said component will be fitted. These purposes and advantages are practically reached through a nickel-based superalloy particularly suitable for the fabrication of mechanical components for a piece of turbomachinery comprising in percentage by weight: chromium between 3% and 7%; tungsten between 3% and 15%; tantalum between 4% and 6%; aluminium between 4% and 8%; carbon less than 0.8%; the remaining percentage of nickel plus impurities. These purposes and advantages are also practically reached through a method for fabricating a nickel-based superalloy, wherein the method comprises mixing in percentage by weight: chromium between 3% and 7%1 tungsten the 3% and 15%; tantalum between 4% and 6%; aluminum between 4% and 8%; carbon less than 0.1%; the remaining percentage of nickel plus impurities.

The technical advantages of this invention are stated in the Claims listed below.

A main aspect of this invention is the production of a nickel-based superalloy suitable for the creation of mechanical components which will be used at high temperatures, around 1200° C., in a piece of turbomachinery. As indicated in the invention, this superalloy includes at least the following elements, in a quantity which is expressed in percentage by weight (below and in the attached claims the percentages indicated are per weight, if not indicated differently): Chromium (Cr) between 3% and 7%, Tunngsten (W) between 3% and 15%, Tantalum (Ta) between 4% and 6%, Aluminium (Al) between 4% and 8%, carbon (C) less than 0.8%, the remaining percentage of Nickel (Ni) and, in addition, possible impurities.

A very convenient application of the invention is the one in which the superalloy includes Yttrium(III) oxide, also called "Yttria" (chemical formula $Y_2O_3$), in a percentage by volume ranging from 0% to 15%, preferably from 0% to 7%, and even more preferably from 0% to 6% in order to enhance the mechanical resistance of the superalloy at high temperatures.

Yttrium(III) oxide is, in a few words, a whitish solid substance which is stable in air, used in several technological fields, such as, for example, in the production of microwave filters or superconducting metals (due to its capacity to become a superconductor at high temperatures), or for the production of some types of organometallic compounds (transforming it into Yttrium(III) chloride, chemical formula $YCl_3$). In another convenient application of the invention, the superalloy includes Rhenium (Re) in a percentage by weight ranging from 0% to 10%, preferably from 3% to 7%, and even more preferably from 4% to 6% so that the mechanical resistance at high temperatures will be enhanced.

Rhenium, in a few words, is a rare, heavy white-silver metal, having a melting point among the highest of all elements, and lower only than the ones of tungsten and carbon. It is also one of the densest metals, surpassed only by platinum, iridium and osmium. Rhenium was the last naturally occurring element to be discovered. It is normally marketed in a powder, which can be compacted by pressure or void sintering, in a hydrogenated atmosphere. Rhenium is not free in nature, and it cannot be found in typical minerals. The quantity which can be found on the earth's crust is of around 0.001 ppm which is to say of around one milligram per ton. It is mainly extracted from the fumes produced by the roasting of minerals containing copper sulphide and of some minerals containing molybdenum, which happen to contain between 0.002% and 0.2% of Rhenium; it can be obtained, for example, from the reduction of ammonium perrhenate with hydrogen at high temperatures. Its purification process is difficult and expensive. The main applications of this element are: the creation of platinum-rhenium catalysts for gas production; the production of filaments and detectors of ions for mass spectrometers; additive for tungsten or molybdenum based alloys to create super conduction alloys; catalyst for hydrogenation processes, to create electric contacts, due to the good wear resistance and resistance against corrosion; an element in the production of thermocouple thermometers which measure temperatures up to 2200° C. and many other applications.

In a very convenient application of this invention, this superalloy includes tungsten in a percentage by weight ranging from 4% to 6% or from 9% to 11% based on the quantity of rhenium, please see below.

In another application the superalloy has at least one of the below mentioned elements in the following percentage by weight: chromium (Cr) between 4% and 6%, tantalum (Ta) between 4.5% and 5.5%, aluminium (Al) between 5% and 7%, carbon below 0.1%. In a specific application the above mentioned alloy, preferably of an equiaxial type, microadditions of hafnium (Hf), zirconium (Zr) and boron (B) might be performed, up to a maximum total of 2%, in order to improve the mechanical specifications based on the specific application.

From another aspect, this invention is related to a method to create a nickel-based superalloy, which includes a step in which the following elements are mixed in the quantity indicated below, (percentage by weight): chromium (Cr) between 3% and 7%, tungsten (W) between 3% and 15%, tantalum (Ta) between 4% and 6%, aluminium (Al) between 4% and 8%, carbon (C) less than 0.8%: the remaining percentage of nickel (Ni) and, in addition, possible impurities. Additional steps might include mixing the superalloy with at least one of the following elements:

- yttrium(III) oxide (Y2O3) in a percentage by volume between 0% and 15% (in volume), preferably between 0% and 7%, even more preferably between 0% and 6%;
- Rhenium (Re) in a percentage by volume between 0% and 10%, preferably between 3% and 7%, most preferably between 4% and 6%;
- Tungsten in a percentage by weight between 4% and 6% or between 9% and 11%, based on the quantity of Rhenium.

In a very convenient application of this invention, this superalloy is obtained through "fusion". "Fusion" refers to those productive processes also called "foundry works" which create casting spouts, for example in sand (called "sand work"), in metal (also called "in shell") or under pressure ("die casting") and many others.

In detail, this superalloy can be created through foundry works called "lost-wax microfusion" which consists in:

- preparing a wax mould of the component to be produced;
- creating, around the wax mould, a specific coating (in general in chalk or phosphatic);
- exposing the created mould, once coated, to a thermal cycle at a high temperature (generically between 650° and 900° C.) to eliminate the wax and create a hollow mould;
- pouring the superalloy in the mould through the specific pouring channels;
- letting the superalloy solidify inside the mould, and then taking it out of the mould itself.

The thermal cycle at a high temperature might be performed following several heating procedures, such as free flame fusion, inductive fusion, fusion on a substrate heated by electric resistance, arc lamp fusion between tungsten electrodes in agglomerate, and many others thereof.

Casting might be carried out through gravity, through gas pushing the alloy, through depression, or also through centrifugal pushing and many others thereof. The solidification process, whether dealing with "lost-wax microfusion" or with any other foundry procedures, can be controlled in order to obtain a single crystal, an equiaxial or a directional solidification, as it will be explained below. In detail, a single crystal microfusion allows obtaining a superalloy with good specifications for all the grain boundaries phenomena (such as for example low creep) with high resistance against oxidation and against mechanical and chemical stress as well as against many other phenomena; on the other hand though, the procedure to obtain such results is complex and expensive. On the other side, the equiaxial fusion is such as to create a more cost effective superalloy which is also easier to produce, but having a lower resistance if compared to the one obtained through single crystal microfusion. Directional microfusion, on the other side, assures a better resistance based on the preferred grain direction. The main advantages of a foundry work, being it "lost-wax" or some other type, are that it is possible to control the cooling to obtain an alloy with good specifications, and at the same time it will be possible to create complex shapes without having to engage in elaborate mechanical works. The possible presence of microporosity, unevenness or undesired phase precipitates entails accurate checks both of the process and of the product.

In a very convenient application of this invention, this superalloy is obtained through "dust metallurgy". "Dust metallurgy" is the production process through which metal (or ceramic) manufactured products are obtained through the thermo-mechanical treatment of their dusts.

In detail, this superalloy can be created through hot compression in order to compact the powders through a "sintering" process which mainly consists in:

- preparing the above mentioned superalloy, eventually with rhenium, in the form of solid particles or dust;
- eventually mixing the above mentioned dusts with yttrium dust;
- pouring the dusts in a high pressure soft mould which reproduces the shape of the object to be created or a similar shape having a suitable oversizing;
- heating under pressure such mould at temperatures of about 0.7^0.9 times below the fusion point of the material in order to sinter it and to make the particles compact, and in order to induce, at the same time, a new crystallization;
- cooling down and opening the mould to get the finished component.

The main advantages of dust metallurgy are that it minimizes or eliminates the need of mechanical work, it happens to be cost effective especially for geometrically complex shapes, and it is possible to obtain a wide choice of materials and final treatments with a good finish and a good reproducibility for each piece, characteristics which fit the requirements for chain production.

The disadvantages are, on the other side, mostly due to the lower mechanical specifications of the finished product and to the lower dimensional precision if compared to the products which are created by fusion. Both in case of foundry work and dust metallurgy, it is possible to include further treatments on the finished component, such as, for example, rectification, lapping, polishing, calibration or any other mechanical finishing treatments, as well as treatments to complete the shape (in case of geometrical restrictions which happen not to be compatible with matrix compression), or thermal treatments aiming at optimising the specifications of the material, as well as many other treatments.

Furthermore, protective coatings might be applied on this superalloy (or better on the finished product made of this superalloy) based on the specific use it is designed for. Another interesting aspect of this invention is the creation of a mechanical component of a piece of turbomachinery made of the above mentioned superalloy which can endure high temperatures while in use (up to about 1200° C. or slightly higher). Another aspect of this invention is the one regarding a piece of turbomachinery in which at least one mechanical component is created with the above mentioned superalloy, such as a gas turbine for example, or many others thereof.

It cannot be excluded that the above mentioned superalloy might be used in other applications or technological fields, where the use of materials which can endure high temperatures (up to about 1200° C.) is required or where high mechanical stress and oxidation and/or corrosion are involved.

Another aspect of this invention relates to a method created to improve the performances of a gas turbine, through the substitution of some parts of its statoric components, which might have created issues at high temperatures, with parts made of a superalloy, as indicated in this invention. Please refer to the description below.

One of the advantages in using a superalloy, as described in this invention, is that, if compared with the nickel-based superalloys, the one described in this document gives the opportunity to raise the temperature of use of a turbomachine component up to about 1200° C. thanks to its composition, which was created ad hoc.

Actually, such superalloy shows a good resistance against oxidation and a high mechanical resistance, at least up to the highest temperature indicated.

In detail, looking at its composition, this superalloy allows to improve at least the following characteristics:

- better resistance against oxidation at temperatures exceeding 1000° C.;
- a higher tensile strength at temperatures exceeding 1100° C.;
- a better stability of the gamma prime hardening phase, which consists of the precipitates in nickel-aluminium (chemical formula Ni3Al) which give superalloys mechanical properties. (up to about 1300° C.).

Thus, it is possible to raise the typical temperature of use (which is not possible with the actual commercial alloys in the turbomachinery field) and to extend the life of the components on equal terms of use, or to reduce remarkably the cooling of the components; consequently the component is simplified and there is less request for a lower protection using thermal barriers.

The advantages arising from using materials characterized by specifications which allow their use at high temperatures are several and they can be summarized in the following list:

- higher performances thanks to the possibility to increase the temperatures of use;
- higher performances thanks to the possibility to reduce the amount of cooling air involved in the operations;
- longer life of components;
- improvement in design and in the productive process of the components thanks to the optimization of the cooling system.

Each one of these technical aspects entails a corresponding economic benefit.

Another advantage is that this superalloy is very versatile, because it can be used either to create machinery or a newly designed component or to implement an improvement of an already existing machine or component. In general the invention can be used in all fields in which an adequate resistance against high temperatures is required, both in terms of mechanical specifications and in terms of resistance against oxidation and corrosion.

Further convenient specifications and ways to apply this method as well the devices indicated in the invention, are described in the attached claims, and will be described in detail below referring to some non limiting examples.

BRIEF DESCRIPTION OF THE DRAWINGS

The numerous purposes and advantages of this invention will be more evident for the experts in this field if they refer to the schematic drawings attached, which show practical, non restrictive examples. In the drawings.

DETAILED DESCRIPTION OF THE INVENTION

A first superalloy created as a first application of the invention was called Ni29 and includes at least the following elements: chromium (Cr) at 5% (in weight); tungsten (W) at 10%; tantalum (Ta) at 5%; rhenium at 0%; aluminium (Al) at 6%; carbon at 0.05% and eventually yttrium(III) oxide ($Y_2O_3$) between 0.5% and 2% (this last one in volume).

A second superalloy created as a second application of the invention was called Ni32 and includes at least the following elements:

chromium (Cr) at 5% (in weight); tungsten (W) at 5%; tantalum (Ta) at 5%; rhenium at 5%; aluminium (Al) at 6%; carbon at 0.05% and eventually yttrium(III) oxide ($Y_2O_3$) between 0.5% and 2% (this last one in volume).

In detail the quantity of tungsten can be balanced with the one of rhenium in an inverse proportion, for example setting 5% of tungsten when rhenium is at 5% and setting it at 10% when rhenium is not there. It cannot be excluded that a quantity of cobalt (Co) will be included, less than 5% (in weight), based on the specific application. Please note that the indication of the composition of the superalloys is only explicative and not limitative for the invention, because it can vary based on the specific application or procedures used in the application itself. FIGS. 1 to 9 show the results of some of the tests performed.

Figure 1:
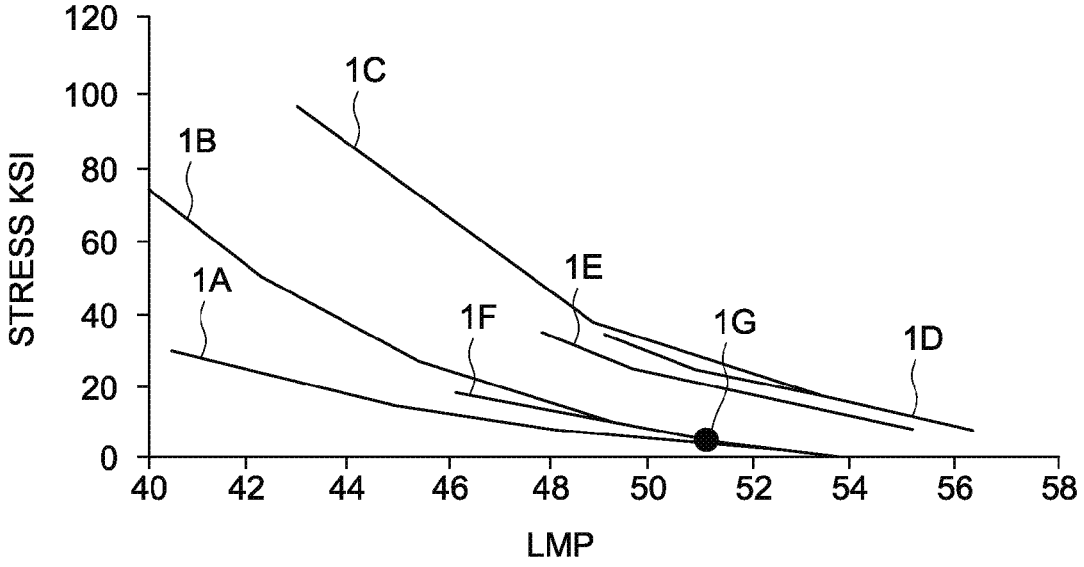
FIG. 1 is a graph which shows the resistance to creep in function of load and temperature of several superalloys based on some application of the invention.

FIG. 1 is a graph which shows the resistance to creep evaluated through stress rupture test, which evaluates the time after which the rupture occurs in a cylindrical sample under a constant load and at a specific test temperature. In the graph the load variation is expressed in kip per square inch (ksi) depending on the Larson-Miller paramenter (LMP), which parameterises the test temperature and the rupture time of several alloys compared to some other alloys created following the method indicated by the invention.

In detail, line 1A is related to the commercial cobalt based alloy FSX414; line 1B in related to the commercial nickel-based alloy GTD222; line 1C is related to the commercial SC Renè N4. Line 1D relates to alloy Ni32 created with the single crystal procedure; line 1E relates to alloy Ni29 created with the single crystal procedure, curve 1F relates to alloy Ni32 following the equiaxial procedure with micro-additions of Hf and Zr, point 1G relates to alloy Ni32 created through dust metallurgy followed by hot extrusion.

Please note, observing the graph, how the invention in its different forms, shows specifications of mechanical resistance almost comparable to the best commercial products and, at the same time, it shows a better resistance to oxidation (please see following figures as well). Furthermore, based on the specific necessities of the project, it is possible to enhance the specifications of the alloy by simply modifying the production process, for example single crystal, equiaxial process and many others thereof. In order to enhance mechanical properties, the production of the invention in its microfused single crystal form, is preferable.

Figure 2:
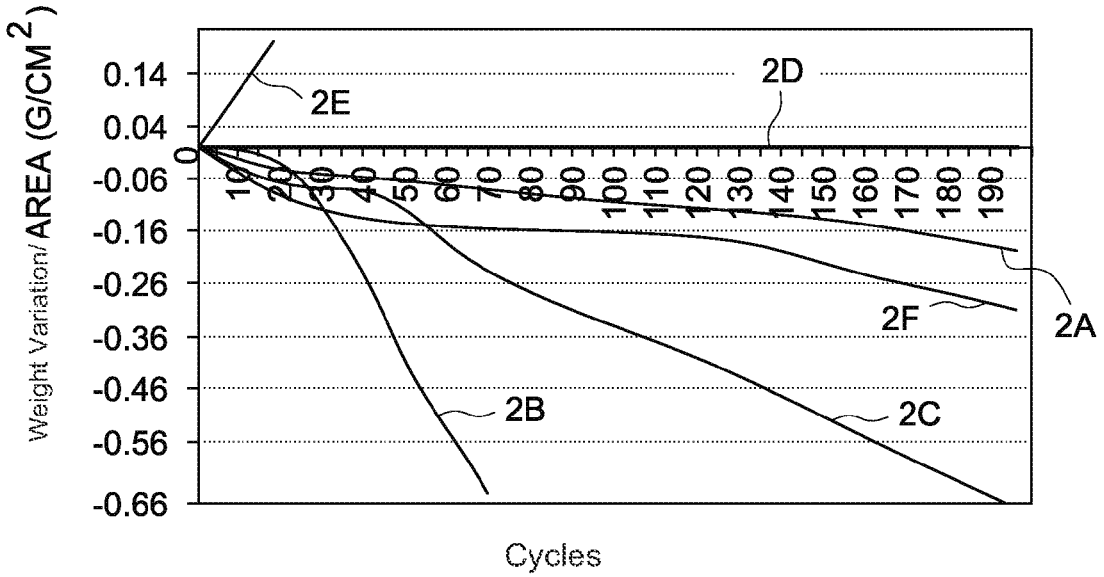
FIGS. 2 and 6 show graphs in which the results of some oxidation tests performed on several superalloys based on some applications of the inventions are shown and compared to some alloys currently in commerce.

FIG. 2 is a graph which shows the resistance against oxidation evaluated measuring the weight variation per area unit ($g/cm^2$) based on the number of cycles performed in a set of cyclical oxidation tests on several alloys; each one of these cycles involves a heating up to 1250° C. for 1 hour and a cool down, at room temperature, for 15 minutes. In detail, line 2A shows the weight variation per area of the Ni29 alloy obtained through dust metallurgy and having 0% of $Y_2O_3$; a second line 2B regards the alloy Ni29 obtained through dust metallurgy and having 5% of $Y_2O_3$; a third line 2C regards the commercial CMSX10®; a fourth line 2D regards the commercial alloy PM2000; a fifth line 2E regards the commercial alloy MA6000; a sixth line 2F regards alloy Ni29 containing 2% (in volume) of $Y_2O_3$.

From this graph it is possible to see how alloys created following the procedure implemented by the invention show a resistance against oxidation which is higher than the one of commercial alloys for high temperatures, exception made for alloy PM2000 which has very low mechanical specifications at high temperatures.

Figure 3:
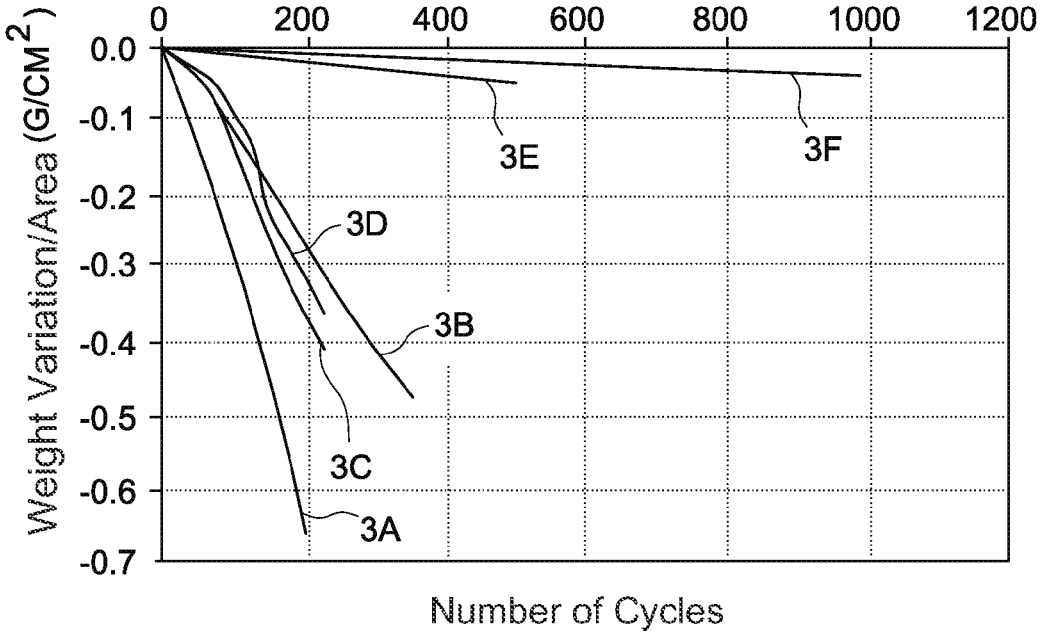

FIG. 3 is a graph which, similarly to the one in FIG. 2 shows the weight variation per area unit (g/cm2) based on the number of cycles performed, in a set of cyclical oxidation tests, on several alloys; each one of these cycles involves a heating up to 1200° C. for 1 hour and a cool down, at room temperature, for 15 minutes. In detail, the first line 3A shows the performance of equiaxial alloy Ni29; a second line 3B shows the performance of equiaxial alloy Ni32; a third line 3C shows the performance of single crystal alloy Ni29; a fourth line 3D shows the performance of single crystal alloy Ni32; a fifth line 3E shows the performance of alloy Ni32 obtained through dust metallurgy; a sixth line 3F shows the performance of alloy Ni29 obtained through dust metallurgy.

It seems evident, from this graph, that the specific production technology affects the resistance against oxidation. In detail, it is advisable to produce the invention through dust metallurgy to optimise the resistance against oxidation without excessively degrading the mechanical properties.

Figure 4:
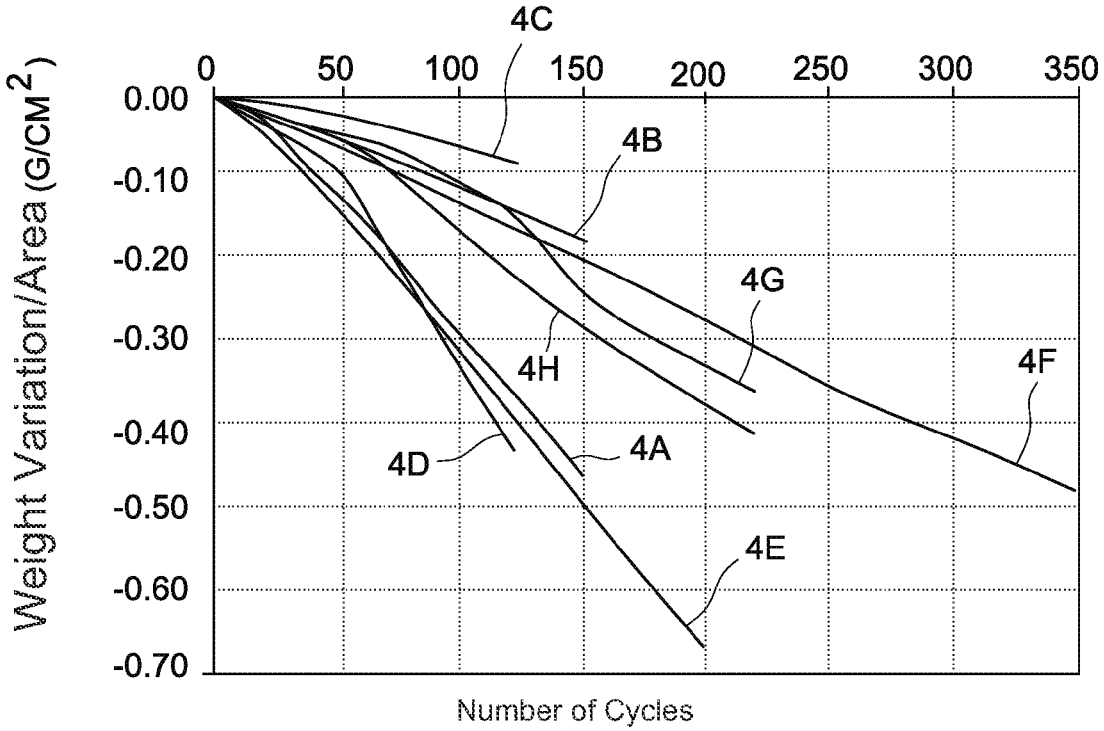

FIG. 4 is a graph which, similarly to the one in FIG. 3 shows the weight variation per area unit ($g/cm^2$) based on the number of cycles performed in a set of cyclical oxidation tests on several alloys produced through microfusion, each one of these cycles involves a heating procedure up to 1200° C. for 1 hour and a cool down procedure, at room temperature, for 15 minutes.

In detail, the first line 4A shows the behaviour of the equiaxial Ni29; a second curve 4B shows the behaviour of the equiaxial alloy Ni32; a third curve 4C shows the behaviour of alloy Ni29 containing less carbon (around 0.005%); a fourth curve 4D shows the behaviour of alloy Ni32 containing less carbon (about 0.005%); a fifth curve 4E shows the behaviour of microfused equiaxial alloy Ni29 which underwent hot isostatic pressing (HIP); a sixth curve 4F shows the behaviour of microfused equiaxial alloy Ni32 which underwent HIP; a seventh line 4G shows the behaviour of single crystal microfused alloy Ni29; an eight line 4H shows the behaviour of the single crystal microfused alloy Ni32.

Figure 5:
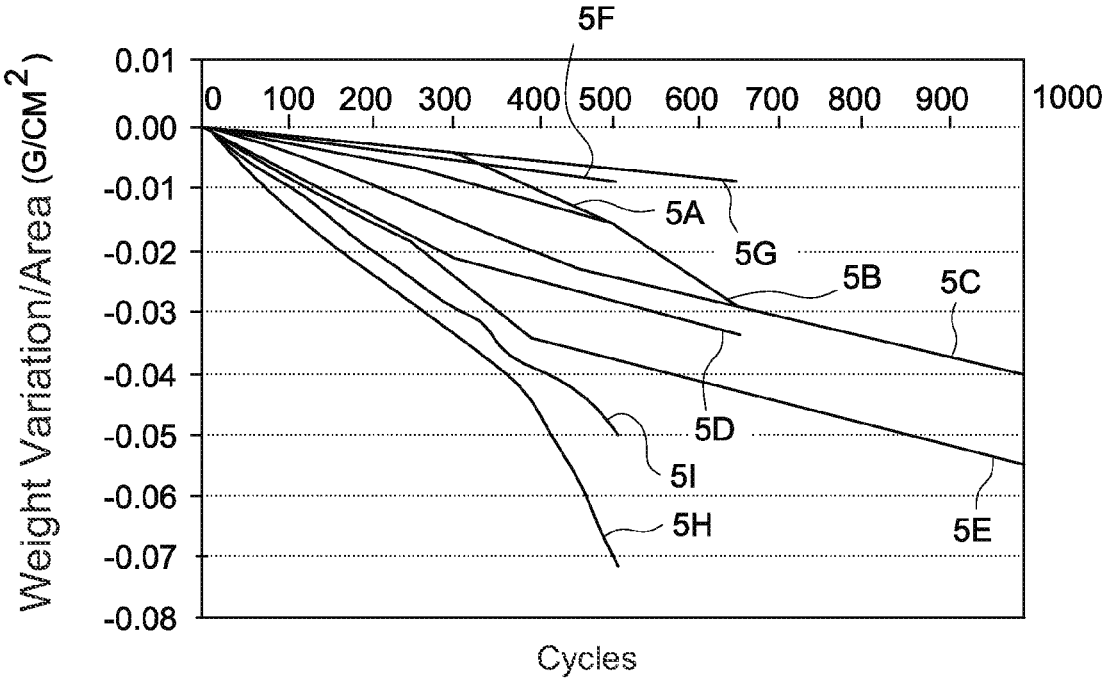

Please note, in this graph, how the variations more or less substantial in the chemical composition within the intervals indicated in the invention, as well as the difference in the microfusion process, allow to create different specifications when undergoing cyclical oxidation. FIG. 5 is a graph which shows the weight variation per area unit ($g/cm^2$) based on the number of cycles performed in a set of cyclical oxidation tests on several alloys produced through dust metallurgy based on the several possible applications of this invention; each one of these cycles involves a heating procedure reaching up to 1200° C. for 1 hour and a cool down procedure, at room temperature, for 15 minutes. In detail, a first and a second line, 5A and 5B show the behaviour of the Ni29 alloy containing 0% of $Y_2O_3$; a third and a fourth line, 5C and 5D show the behaviour of Ni29 alloy containing 0.5% (per volume) of $Y_2O_3$; a fifth line 5E showing the behaviour of the Ni29 alloy containing 1% (per volume) of $Y_2O_3$; a sixth and a seventh line 5F and 5*g* show the behaviour of Ni32 alloy containing 1% (in volume) of $Y_2O_3$; and eighth line 5H shows the behaviour of alloy Ni32 with 0.5% (in volume) of $Y_2O_3$; a ninth line SI shows the behaviour of alloy Ni32 with 1% (in volume) of $Y_2O_3$. Please note that this graph shows clearly how the concentration of yttrium(III) oxide in the superalloy produced through dust metallurgy following the procedures indicated in the invention, is strictly linked to the resistance against oxidation.

Figure 6:
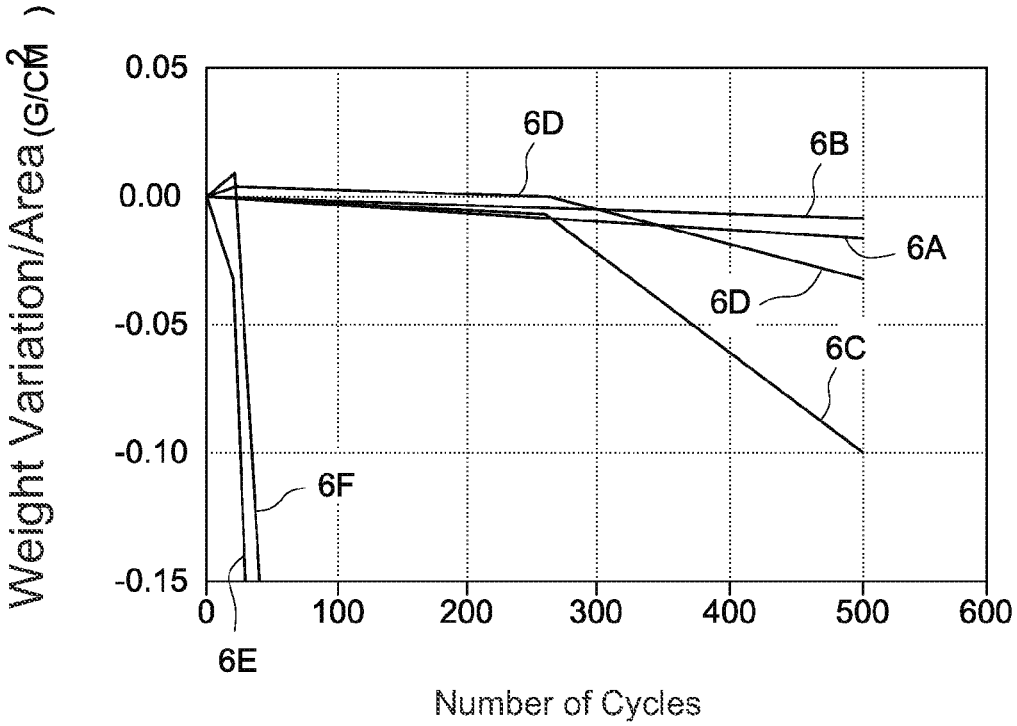

FIG. 6 is a graph which shows the weight variation per area unit ($g/cm^2$) based on the number of cycles performed in a set of cyclical oxidation tests on several alloys type Ni29, which underwent sintering, based on one of the procedures described in this invention; each one of these cycles involves a heating procedure reaching up to 1200° C. for 1 hour and a cool down procedure, at room temperature, for 15 minutes.

In detail, a first line 6A shows the behaviour of alloy Ni29; a second line 6B shows the behaviour of alloy Ni32 containing 2% (in volume) of $Y_2O_3$; a third line 6C regarding the Ni32 alloy containing the 5% (in volume) of $Y_2O_3$; a fourth line 6D of alloy Ni32 showing 10% (in volume) of $Y_2O_3$; a fifth line 6E of alloy Ni32 containing 20% (in volume) of $Y_2O_3$; a sixth line 6F of alloy Ni32 containing 40% (in volume) of $Y_2O_3$.

Figure 7:
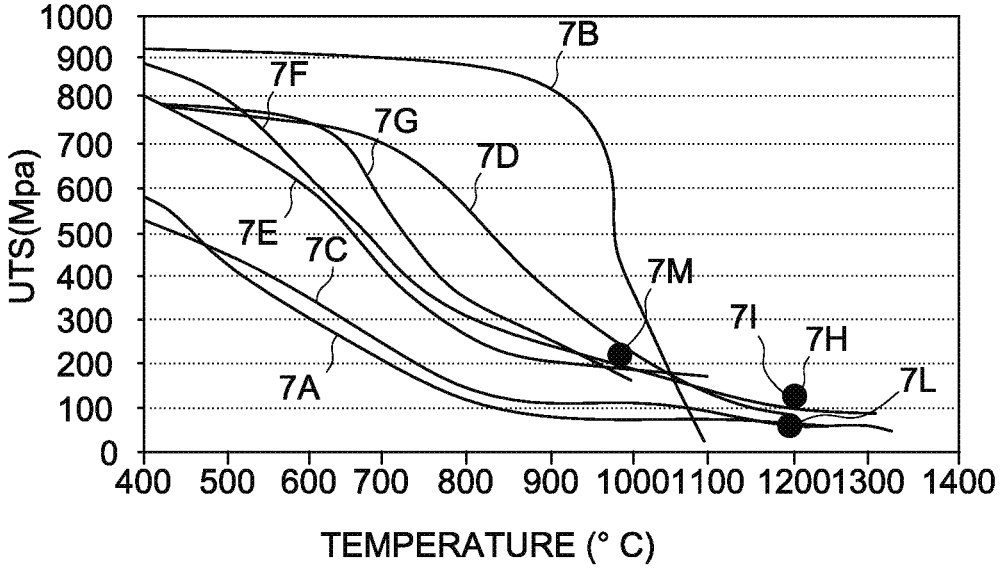
FIG. 7 shows an explanatory graph regarding traction resistance at high temperatures of an application of the invention compared to some commercial alloys.

Please note how a high concentration of Yttrium(III) oxide, exceeding 20%, decreases the resistance against oxidation. FIG. 7 is a graph showing the results for traction tests of commercial alloys compared to the alloys created following the procedures indicated in the invention.

Figure 8:
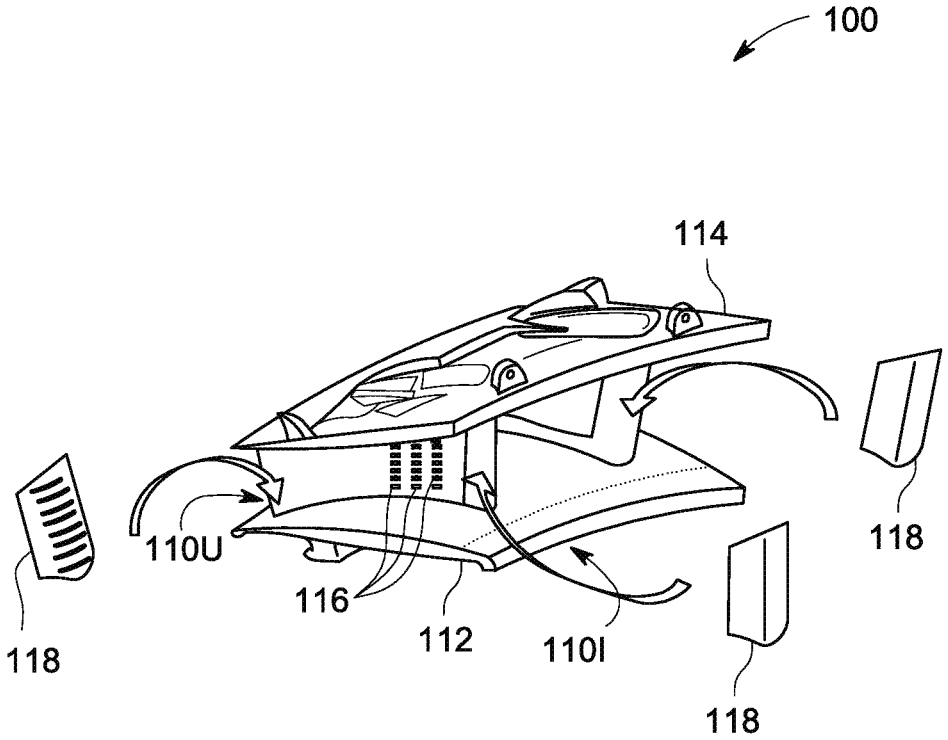
FIG. 8 shows a partially exploded axonometric view of a component of a piece of turbomachinery based on one application of the invention.

In detail, the first line 7A shows the behaviour of alloy MA754; a second line 7B shows the behaviour of alloy MAR-M200; a third line 7C shows alloy MA956; a fourth line 7D alloy HA188; a fifth line 7E alloy PM1000; a sixth line 7F alloy PM2000 and a seventh line 7G alloy MA758. Point 7H shows the results achieved with single crystal Ni29 and point 7I the results achieved with single crystal Ni32 (almost overlapping the graph); point 7L shows alloy Ni29 created through dust metallurgy followed by hot extrusion and point 7M shows equiaxial alloy Ni29. Please note that the mechanical properties at high temperatures are comparable to the ones of commercial alloys showing, in the "single crystal" case, better specifications. FIG. 8 shows a partial axonometric view of a mechanical system 100 of a turbine which is composed of several empty aerodynamic spaces created between two side by side nozzles 111 separated and contained by an internal wall 112 and an external one 114. The design of these nozzles and their support inside the turbine aims at compensating, at least in part, the deformations caused by hot gas and at keeping them correctly aligned with the gas path.

Cooling systems for the nozzles can also be implemented; these consist of a set of holes 116 through which cooling gas circulates from the inside towards the outside parts of this component so that the life of the component itself will be extended. Based on the procedure indicated in the invention, moulded insets 118 are included in the device—shown in an exploded view in FIG. 8. They are made of an alloy created following the procedures indicated in the invention, and they rest in the entry section 100I and in the exit section 100U of the nozzles, which are critical area for these components. The presence of the moulded inserts will extend the life of the component.

These insets 118 can be included in the project of a new component or, as an alternative, can be fitted in a used component to extend its life.

The mechanical system 100 is obviously shown as an exemplification, the alloy described in the invention is suitable to create other components or other mechanical systems based on the specific applications and needs.

It is agreed that the illustration is only an indication and that it does not, in any way, limit the possibilities of the invention, which can vary in form and ways always being pertinent to the foundation at the base of the invention itself. The possible presence of referral numbers in the claims has the only purpose to facilitate reading in the light of the previous descriptions and of the attached drawings and it does not limit, in any way, the scope of protection.

What is claimed is:

1. A nickel-based superalloy particularly suitable for the fabrication of mechanical components for a piece of turbomachinery, the superalloy consisting of in percentage by weight:

chromium between 4% and 6%;
tungsten between 3% and 15%;
tantalum between 4.5% and 5.5%;
aluminium between 5% and 7%;
carbon less than 0.1%;
yttrium oxide present in a percentage by volume of up to 7%;
optionally cobalt in less than 5%;
optionally one or more of hafnium or zirconium up to a total of 2%;
optionally rhenium between 0% and 10%;
the remaining percentage of nickel plus impurities.

2. The superalloy according to claim 1, wherein the rhenium is present according to the following percentage by weight: between 0% and 10%.

3. The superalloy according to claim 2, wherein the tungsten is in percentage by weight between 4% and 6%, wherein the sum of the percentage by weight of the tungsten and the rhenium is 10%, and wherein the percentage by weight of the tungsten is inversely proportional to the percentage by weight of the rhenium.

4. The superalloy according to claim 1, wherein the tungsten is in percentage by weight between 9% and 11%.

5. A mechanical component for a piece of turbomachinery fabricated from a nickel-based superalloy according to claim 1.

6. A piece of turbomachinery comprising at least one mechanical component according to claim 5.

7. The superalloy according to claim 1, wherein the rhenium is present according to the following percentage by weight: between 3% and 7%.

8. The superalloy according to claim 1, wherein the rhenium is present according to the following percentage by weight: between 4% and 6%.

9. A nickel-based superalloy consisting of, in percentage by weight:

chromium between 4% and 6%;
tungsten between 3% and 15%;
tantalum between 4.5% and 5.5%;
aluminium between 5% and 7%;
carbon less than 0.1%;
yttrium oxide present in a percentage by volume of 0.5% to 2%;
optionally cobalt in less than 5%;
optionally one or more of hafnium or zirconium up to a total of 2%;
optionally rhenium between 0% and 10%;
the remaining percentage of nickel plus impurities;
wherein said superalloy is characterized by oxidation resistance at 1200° C. while in use as a turbomachine component.

10. A method for fabricating a nickel-based superalloy, wherein the method consists of mixing in percentage by weight:

chromium between 4% and 6%;
tungsten between 3% and 15%;
tantalum between 4.5% and 5.5%;
aluminium between 5% and 7%;
carbon less than 0.1%;
yttrium oxide present in a percentage by volume of up to 7%;
rhenium in percentage by weight between 0% and 10%;
optionally cobalt in less than 5%;
optionally one or more of hafnium or zirconium up to a total of 2%;
the remaining percentage of nickel plus impurities.

11. A mechanical component for a piece of turbomachinery fabricated from a nickel-based superalloy fabricated by a method according to claim 10.

12. A piece of turbomachinery comprising at least one mechanical component according to claim 11.

13. The method according to claim 10, wherein the rhenium is mixed in percentage by weight between 3% and 7%.

14. The method according to claim 10, wherein the rhenium is mixed in percentage by weight between 4% and 6%.

15. The method according to claim 10, wherein the tungsten is mixed in percentage by weight between 9% and 11%.

16. The method according to claim 10, wherein the tungsten is mixed in percentage by weight between 4% and 6%, wherein the sum of the percentage by weight of the tungsten and the rhenium is 10%, and wherein the percentage by weight of the tungsten is inversely proportional to the percentage by weight of the rhenium.

* * * * *